United States Patent [19]

Mayes

[11] Patent Number: 4,787,218

[45] Date of Patent: Nov. 29, 1988

[54] HOSIERY DYE BAGS

[75] Inventor: R. Rodger Mayes, Burlington, N.C.

[73] Assignee: Fuller Specialty Co., Burlington, N.C.

[21] Appl. No.: 927,952

[22] Filed: Nov. 7, 1986

[51] Int. Cl.[4] ..... D04B 7/16

[52] U.S. Cl. ..... 66/170; 66/202; 428/253

[58] Field of Search ..... 428/253; 66/170, 202

[56] References Cited

U.S. PATENT DOCUMENTS 3,331,221 7/1967 Lawson ..... 66/170

4,280,342 7/1981 Eng et al. ..... 66/202

4,601,940 7/1986 Fischer ..... 428/253

*Primary Examiner*—James J. Bell

*Attorney, Agent, or Firm*—C. Robert Rhodes; Judith E. Garmon

[57] ABSTRACT

Dye bags for hosiery and similar apparel formed from a tricot fabric made of 60 denier, 100% polypropylene yarn. Such bags in use exhibit non-staining, and anti-snagging characteristics, do not have to be scoured after each usage, and will eliminate the buildup of static electricity in the polyester and/or nylon apparel carried therein.

5 Claims, No Drawings

HOSIERY DYE BAGS

BACKGROUND OF THE SUMMARY OF THE PRESENT INVENTION

This application relates to the dyeing of hosiery and similar lighter weight, delicate apparel, and more particularly to dye bags formed of a novel fabric tending to reduce or eliminate static electricity in and on the apparel contained therein and exhibiting non-staining characteristics.

Previously in the hosiery industry dye bags have historically been made of an open type mesh fabric. As hosiery and other delicate articles have become lighter in weight and more delicate, such open mesh dye bags have presented problems. Such problems occur by portions of the apparel protruding through or becoming lodged in the mesh openings resulting in picks and other types of damage to the hosiery.

In order to address the above problems, in recent years such dye bags have been formed of a tighter knit (tricot construction) utilizing polyester yarn. The use of such polyester tricot bags has become widespread, however, polyester as a yarn for dye bag fabric suffers from two major disadvantages. First of all, polyester fiber accepts the dye stuffs utilized in dyeing hosiery, becomes stained, and must be scoured between each usage. Further, when used in conjunction with nylon or polyester hosiery, generates static electricity as a result of the nylon or polyester rubbing against the polyester fabric of the bag.

Polypropylene, on the other hand, has not generally been considered as a yarn used in tricot constructions because of its relatively large denier size Applicant has discovered, with the recent advent of smaller denier polypropylene, that it can be successfully incorporated in a tricot construction both of the aforesaid problems can be obviated. Polypropylene has no affinity for dye stuffs, and therefore, eliminates the need for scouring between usages. Secondly, polypropylene is inherently an anti-static material when used in conjunction with nylon and/or polyester, because polypropylene takes an opposite charge from that generated by nylon and/or polyester. Therefore, the hazards and annoyance of static electricity is minimized or eliminated all together. In accordance with the present invention, 60 denier polypropylene fabric for dye bags is constructed by a tricot process, therefore, eliminating scouring, static buildup, and keeping pick levels and damaged apparel to a minimum level.

It is therefore an object of the present invention to provide a unique fabric for dye bags.

It is another object of the present invention to provide a polypropylene tricot fabric for dye bags which minimizes damage to apparel, eliminates the need for scouring between usage, and is anti-static.

Other objects and a fuller understanding of the invention will become apparent from reading the following description of a preferred embodiment.

DETAILED DESCRIPTION OF A PREFERRED EMBODIMENT

The critical aspects of the present invention are the yarns selected and the type of construction utilized. In general, the yarn is polypropylene and the construction is tricot.

A peculiar characteristic of polypropylene is that it has very little, if any, affinity for dye stuffs of the type used for dyeing hosiery. This means that a polypropylene yarn or a fabric made from polypropylene yarn will not itself become dyed or stained as a result of merely dipping it in a tank of dye stuff of a type normally used for dyeing hosiery. Polyester yarn, on the other hand, has an affinity for dye and may become dyed or stained when used as a dye bag. As a result, it must be scoured after each usage.

A second property of polypropylene is that it does not generate static electricity when rubbed by nylon or polyester, because polypropylene takes an opposite charge from that generated by nylon and polyester. Thus, a fabric formed of polypropylene will not build up a static charge (or is anti-static) in the presence of nylon and polyester. Both of these characteristics are extremely important as far as the construction of a dye bag is concerned.

A further consideration of polypropylene which may not make it apparent, at first blush, to utilize in connection with a hosiery dye bag is that it is generally not available in small deniers. Until very recently the smallest denier polypropylene commercially available was on the order of 135 denier. This is entirely too coarse to be utilized in a tightly knitted dye bag. Finally, polypropylene has inherent characteristics that make it difficult to knit in tight constructions successfully. It is abrasive, has low elasticity, has a low melting point, is not heat stable, and tends to result in an unsatisfactory material for fabrics that are desired to be tightly knit and yet exhibit good dimensional stability. Dye bags are generally not subject to high temperatures and therefore the low melting point is not a factor in the use of this fabric for dye bags.

In order to achieve a fabric having tighter coverage which will not damage hosiery and delicate articles as is the case with mesh bags, only fine denier yarns are appropriate. A 60 denier, 100% polypropylene is the yarn selected for the present invention. This will exhibit good anti-static characteristics, will resist dyeing, and will allow the construction of a fabric of a tight coverage (tricot) to prevent damage to the hosiery and other delicate apparel articles. While smaller deniers of polypropylene would also be appropriate, it is believed that an 80 denier polypropylene would probably be the maximum size yarn that could be utilized in the present situation.

In order to achieve the tighter coverage, a tricot construction is selected. Preferably, the tricot construction utilized with the present invention is the "reverse jersey," a fabric that is knitted with a 1–2, 1–0 lap on the front guide bar and a 1–0, 2–3 lap on the rear guide bar.

Because of the inherent characteristics listed above of polypropylene which make it difficult to knit, care must be used to knit the polypropylene at a much slower speed than would be utilized for either nylon or polyester because of denier variations and yarn quality. The warping tension is more critical and must be more closely controlled. Special lubricants are required during the warping operation.

However, the resulting fabric and dye bags constructed therefrom are superior as far as their characteristics are concerned. Such dye bags are, as previously mentioned, dye and stain resistant. In this regard the polypropylene releases dye stuff residue and knitting oils during the rinse cycle of the dyeing cycle, therefore, the scouring operation is eliminated. Polypropylene is, in general, a more absorbant synthetic material than polyester which will cause more moisture to be transferred to the fabric surface of the bag, enabling faster drying of the dyed apparel articles. As stated hereinabove, polypropylene develops the lowest charge of any synthetic fiber, thus essentially eliminates annoyance and possible hazards of static electricity.

Another property of polypropylene is that it exhibits the lowest specific gravity of any synthetic fiber. As a result, the fabric according to the present invention realizes more cover per pound of fiber, thus offering greater protection of hosiery for a given tricot type knitting construction. In this regard polypropylene is 35% lighter than polyester.

Moisture accumulating on the surface of polypropylene evaporates rapidly and the fiber has no moisture regaining properties. Thus, the dye bags of the present invention are mildew resistant. Mildew can be a significant problem because if present in dye bags, it will affect the dyeability of the hosiery carried thereby and cause spotting and/or streaking.

While a preferred embodiment of the present invention has been described in detail hereinabove, it is apparent that various changes and modifications might be made without departing from the scope of the invention which is set forth in the accompanying claims.

What is claimed is:

1. A dye bag for nylon or polyester hosiery and similar apparel, said dye bag being made from a tricot fabric composed primarily of 100% polypropylene yarn, said fabric having the characteristics of lacking an affinity for dye stuffs and preventing a build up of static electricity in or damage to the nylon or polyester apparel.

2. The dye bag according to claim 1 wherein said polypropylene yarn is of a size no greater than 60 denier.

3. The dye bag according to claim 2 wherein said tricot fabric is knitted in a "reverse jersey" construction (1–2, 1–0 lap on the front guide bar and 1–0, 2–3 lap on the rear guide bar).

4. Fabric for use in construction of dye bags for nylon or polyester hosiery and like apparel, said fabric composed primarily of 60 denier, 100% polypropylene yarn and formed by a tricot process, said fabric having characteristics of lacking an affinity for dye stuffs and preventing the build up of static electricity in or damage to the nylon and/or polyester apparel.

5. The fabric according to claim 4 wherein said tricot process is a reverse jersey process with a 1–2, 1–0 lap on the front guide bar and a 1–0, 2–3 lap on the rear guide bar.

* * * * *